US011682862B2

(12) United States Patent
Gurney et al.

(10) Patent No.: US 11,682,862 B2
(45) Date of Patent: Jun. 20, 2023

(54) POWER OUTLET WITH RETENTION AND SHOCK PROTECTION

(71) Applicant: INTERNATIONAL BUSINESS MACHINES CORPORATION, Armonk, NY (US)

(72) Inventors: Franklin Gurney, Rhinebeck, NY (US); Noah Singer, White Plains, NY (US); Khaalid Persaud Juggan McMillan, Poughkeepsie, NY (US); Ryan Elsasser, Poughkeepsie, NY (US); Suraush Khambati, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 44 days.

(21) Appl. No.: 17/447,205

(22) Filed: Sep. 9, 2021

(65) Prior Publication Data

US 2023/0072215 A1 Mar. 9, 2023

(51) Int. Cl.
*H01R 13/639* (2006.01)
*H01R 13/20* (2006.01)

(52) U.S. Cl.
CPC ..... *H01R 13/6395* (2013.01); *H01R 13/20* (2013.01)

(58) Field of Classification Search
CPC . H01R 13/6395; H01R 13/22; H01R 13/6595
See application file for complete search history.

(56) References Cited

U.S. PATENT DOCUMENTS

| | | | | |
|---|---|---|---|---|
| 3,147,055 A | | 9/1964 | Rubens | |
| 3,543,218 A | * | 11/1970 | Archer | H01R 13/20 439/923 |
| 3,786,392 A | | 1/1974 | McDaniel | |
| 3,891,289 A | | 6/1975 | Hanke | |
| 4,007,976 A | * | 2/1977 | Knecht | H01R 13/652 439/144 |
| 4,061,409 A | * | 12/1977 | Bealmear | H01R 13/20 439/372 |
| 4,111,509 A | | 9/1978 | Novak | |
| 4,136,919 A | * | 1/1979 | Howard | H01R 13/20 439/346 |
| 4,167,658 A | * | 9/1979 | Sherman | H01H 27/06 200/51 R |

(Continued)

FOREIGN PATENT DOCUMENTS

| | | |
|---|---|---|
| CN | 2561125 Y | 7/2003 |
| WO | 2020024124 A1 | 2/2020 |

OTHER PUBLICATIONS http://www.hospital-data.com/accidents/115-vacuum-cleaners/eyeball/ in . . . , Accidents—Vacuum cleaners—Years 1997-2010—Eyeball, Hospital-Data.com, accessed Apr. 14, 2021, pp. 1-17.

*Primary Examiner* — Neil Abrams
(74) *Attorney, Agent, or Firm* — Tihon Poltavets

(57) ABSTRACT

An apparatus includes an electrical plug insertable into a power outlet of a receptacle, where the electrical plug includes a ground pin with an indent. The apparatus further includes a retention mechanism enclosed by the receptacle includes a rod configured to interact with the indent of the ground pin, where the rod seated within the indent of the ground pin prevents a removal of the electrical plug from the power outlet.

19 Claims, 7 Drawing Sheets

(56) References Cited

U.S. PATENT DOCUMENTS

| | | | | | |
|---|---|---|---|---|---|
| 4,391,481 | A | | 7/1983 | Golden | |
| 4,820,187 | A | * | 4/1989 | May | H02G 3/12 439/346 |
| 4,925,396 | A | * | 5/1990 | Grover | H01R 13/639 439/147 |
| 5,082,450 | A | | 1/1992 | Warren, Sr. | |
| 5,190,466 | A | | 3/1993 | McVey | |
| 5,194,013 | A | * | 3/1993 | Propp | H01R 13/6392 439/265 |
| 5,249,976 | A | * | 10/1993 | Brock | H01R 13/639 439/270 |
| 5,316,493 | A | * | 5/1994 | Sowers | H01R 13/6395 439/148 |
| 5,921,799 | A | | 7/1999 | Forrester | |
| 6,533,598 | B1 | * | 3/2003 | Bentley | H01R 13/6395 439/346 |
| 6,537,089 | B1 | | 3/2003 | Montague | |
| 6,652,307 | B2 | * | 11/2003 | Tatz | H01R 13/6397 439/346 |
| 7,080,889 | B2 | * | 7/2006 | Ling | H01R 13/6397 200/50.02 |
| 7,172,451 | B1 | | 2/2007 | Ratzlaff | |
| 7,175,463 | B2 | | 2/2007 | Burton | |
| 8,152,554 | B2 | * | 4/2012 | Chapel | H01R 13/652 439/346 |
| 8,926,350 | B2 | | 1/2015 | Wolfe | |
| 10,256,571 | B2 | | 4/2019 | Chapel | |
| 10,468,833 | B1 | | 11/2019 | Fusselman | |
| 2011/0003494 | A1 | | 1/2011 | Tang | |
| 2023/0072215 | A1 | * | 3/2023 | Gurney | H01R 13/20 |

* cited by examiner

POWER OUTLET WITH RETENTION AND SHOCK PROTECTION

BACKGROUND

This disclosure relates generally to power outlet and plug combinations, and in particular, to power outlet and plug combination with integrated retention and shock protection.

Power outlet and plug combinations are widely utilized across multiple applications for providing power to various electronic devices. Loosely plugged connections between the power outlet and plug combination can damage wiring within walls due to overheating, trip a circuit breaker, or blow a fuse. A loose plug can also cause electrical arcing, where current flows through an air gap between conductors and is often a major source for electrical fires. Furthermore, pulling on a plug without positive retention can result in the plug being pulled from the socket in a manner that is damaging to the socket, the plug, and possibly to anyone in a vicinity of the plug. An NEMA 15-5 120 v AC is an example of a common 3 prong (i.e., live, neutral, ground) electrical power connection utilized for providing power to various electronic devices that can be loosely plugged into a corresponding power outlet.

SUMMARY

An aspect of an embodiment of the present invention discloses an apparatus for a power outlet and plug combination with retention and shock prevention, the apparatus comprising an electrical plug insertable into a power outlet of a receptacle, wherein the electrical plug includes a ground pin with an indent. The apparatus further comprises a retention mechanism enclosed by the receptacle includes a rod configured to interact with the indent of the ground pin, wherein the rod seated within the indent of the ground pin prevents a removal of the electrical plug from the power outlet.

Another aspect of an embodiment of the present invention discloses an apparatus for a power outlet and plug combination with retention and shock prevention, the apparatus comprising an electrical plug insertable into a power outlet, wherein the electrical plug includes a ground pin with an indent. The apparatus further comprises a retention mechanism includes a rod configured to interact with the indent of the ground pin, wherein the rod seated within the indent of the ground pin prevents a removal of the electrical plug from the power outlet.

BRIEF DESCRIPTION OF THE SEVERAL VIEWS OF THE DRAWINGS

The following detailed description, given by way of example and not intended to limit the disclosure solely thereto, will best be appreciated in conjunction with the accompanying drawings, in which.

DETAILED DESCRIPTION

Figure 1A:
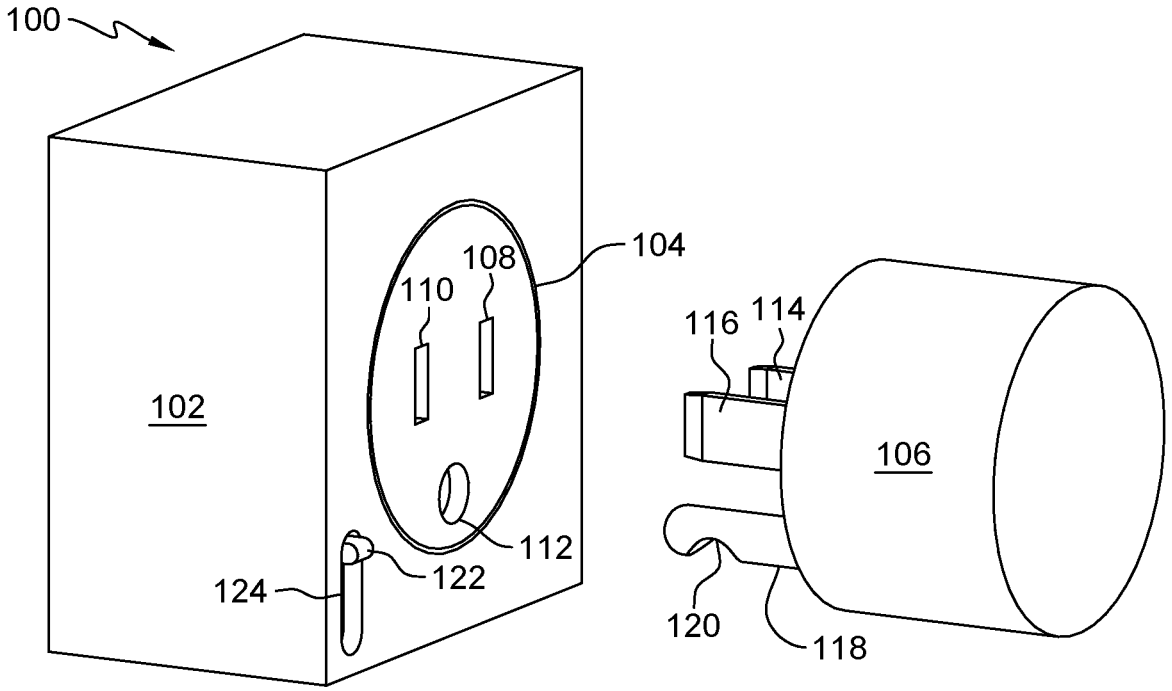
FIG. 1A depicts a 3-dimensional view of a power outlet and receptacle with a retention mechanism and a corresponding plug prior to insertion, in accordance with an embodiment of the present invention.

Detailed embodiments of the present invention are disclosed herein with reference to the accompanying drawings; however, it is to be understood that the disclosed embodiments are merely illustrative of potential embodiments of the invention and may take various forms. In addition, each of the examples given in connection with the various embodiments is also intended to be illustrative, and not restrictive. This description is intended to be interpreted merely as a representative basis for teaching one skilled in the art to variously employ the various aspects of the present disclosure. In the description, details of well-known features and techniques may be omitted to avoid unnecessarily obscuring the presented embodiments.

For purposes of the description hereinafter, terms such as "upper", "lower", "right", "left", "vertical", "horizontal", "top", "bottom", and derivatives thereof shall relate to the disclosed structures and methods, as oriented in the drawing figures. Terms such as "above", "overlying", "atop", "on top", "positioned on" or "positioned atop" mean that a first element, such as a first structure, is present on a second element, such as a second structure, wherein intervening elements, such as an interface structure may be present between the first element and the second element. The term "direct contact" means that a first element, such as a first structure, and a second element, such as a second structure, are connected without any intermediary conducting, insulating or semiconductor layers at the interface of the two elements. The term substantially, or substantially similar, refer to instances in which the difference in length, height, or orientation convey no practical difference between the definite recitation (e.g. the phrase sans the substantially similar term), and the substantially similar variations. In one embodiment, substantial (and its derivatives) denote a difference by a generally accepted engineering or manufacturing tolerance for similar devices, up to, for example, 10% deviation in value or 10° deviation in angle.

In the interest of not obscuring the presentation of embodiments of the present invention, in the following detailed description, some processing steps or operations that are known in the art may have been combined together for presentation and for illustration purposes and in some instances may have not been described in detail. In other instances, some processing steps or operations that are known in the art may not be described at all. It should be understood that the following description is rather focused on the distinctive features or elements of various embodiments of the present invention.

FIG. 1A depicts a 3-dimensional view of a power outlet and receptacle with a retention mechanism and a corresponding plug prior to insertion, in accordance with an embodiment of the present invention. In the illustrated embodiment, power outlet and plug combination 100 includes receptacle 102 with power outlet 104 and plug 106, where plug 106 is insertable into power outlet 104. Power outlet 104 includes live aperture 108, neutral aperture 110, and ground aperture 112, where plug 106 includes live pin 114, neutral pin 116, and ground pin 118 positioned for insertion into the respective apertures of power outlet 104. To ensure maximum safety during insertion, plug 106 should be inserted perpendicular to a face of power outlet 104, where live pin 114 aligns with live aperture 108, neutral pin 116 aligns with neutral pin 116, and ground pin 118 aligns with ground aperture 112. Ground pin 118 of plug 106 includes indent 120 positioned on a lower portion of ground pin 118 for interacting with a retention mechanism, discussed in further detail with regards to FIG. 2. Receptacle 102 includes release lever 122 protruding from a side shared with the face of power outlet 104 with live aperture 108, neutral aperture 110, and ground aperture 112. Release lever 122 is spring loaded in a downwards direction along release guide 124, where applying a downward on release lever 122 disengages the retention mechanism and allows for the removal of plug 106 from power outlet 104. Release guide 124 dictates a vertical movement of release lever 122 when translating a force to the retention mechanism. Operations of release lever 122 are discussed in further detail with regards to FIGS. 4A, 4B and 4C. It is to be noted that receptacle 102 with power outlet 104 can accept any traditional 3-prong plug (i.e., ground pin without an indent), where the retention mechanism does not engage with a ground pin of the 3-prong plug. However, a force applied onto the ground pin of the 3-prong plug by the retention mechanism does provide retention to a lesser extent due to a frictional interaction between the ground pin and a rod of the retention mechanism.

Figure 1B:
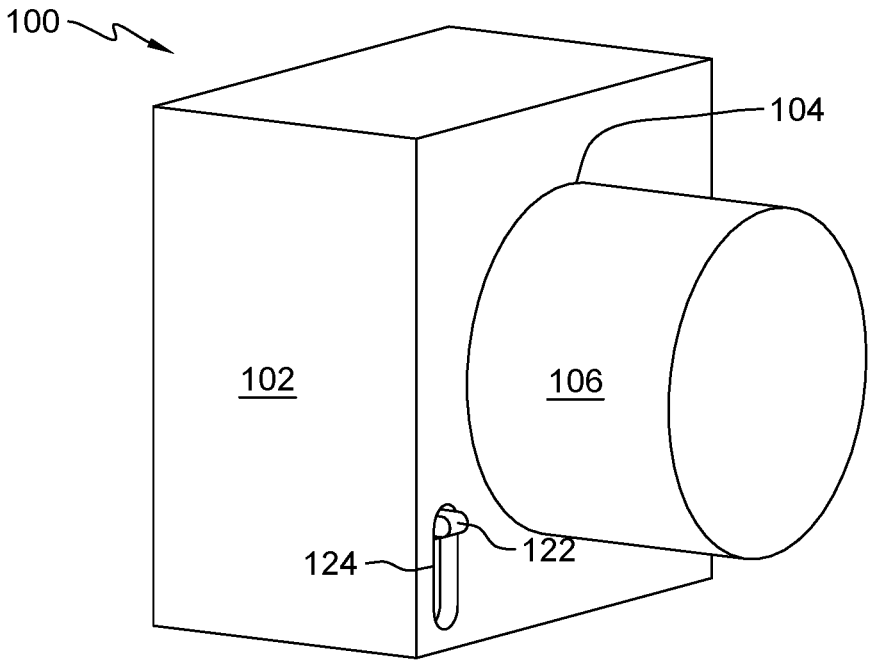
FIG. 1B depicts a 3-dimensional view of a power outlet and receptacle with a retention mechanism and a corresponding plug subsequent to insertion, in accordance with an embodiment of the present invention.

FIG. 1B depicts a 3-dimensional view of a power outlet and receptacle with a retention mechanism and a corresponding plug subsequent to insertion, in accordance with an embodiment of the present invention. In the illustrated embodiment, plug 106 is inserted and seated in power outlet 104 of receptacle 102. In addition to release lever 122 providing a means of disengaging the retention mechanism, release lever 122 is also an indicator for when plug 106 is safely seated in power outlet 104 of receptacle 102. If plug 106 is safely seated in power outlet 104 and the retention mechanism is engaged preventing plug 106 from being inadvertently removed from power outlet 104, release lever 122 is in a topmost position along release guide 124. However, if plug 106 is not safely seated in power outlet 104 and the retention mechanism is not engaged allowing for plug 106 to be inadvertently removed from power outlet 104, release lever 122 would be in any position other than the topmost position along release guide 124. It is to be noted, though not illustrated in the Figures, plug 106 is associated with an electronic device requiring a plugged connection for power, where a second end of plug 106 includes a wired connection to the electronic device.

Figure 2:
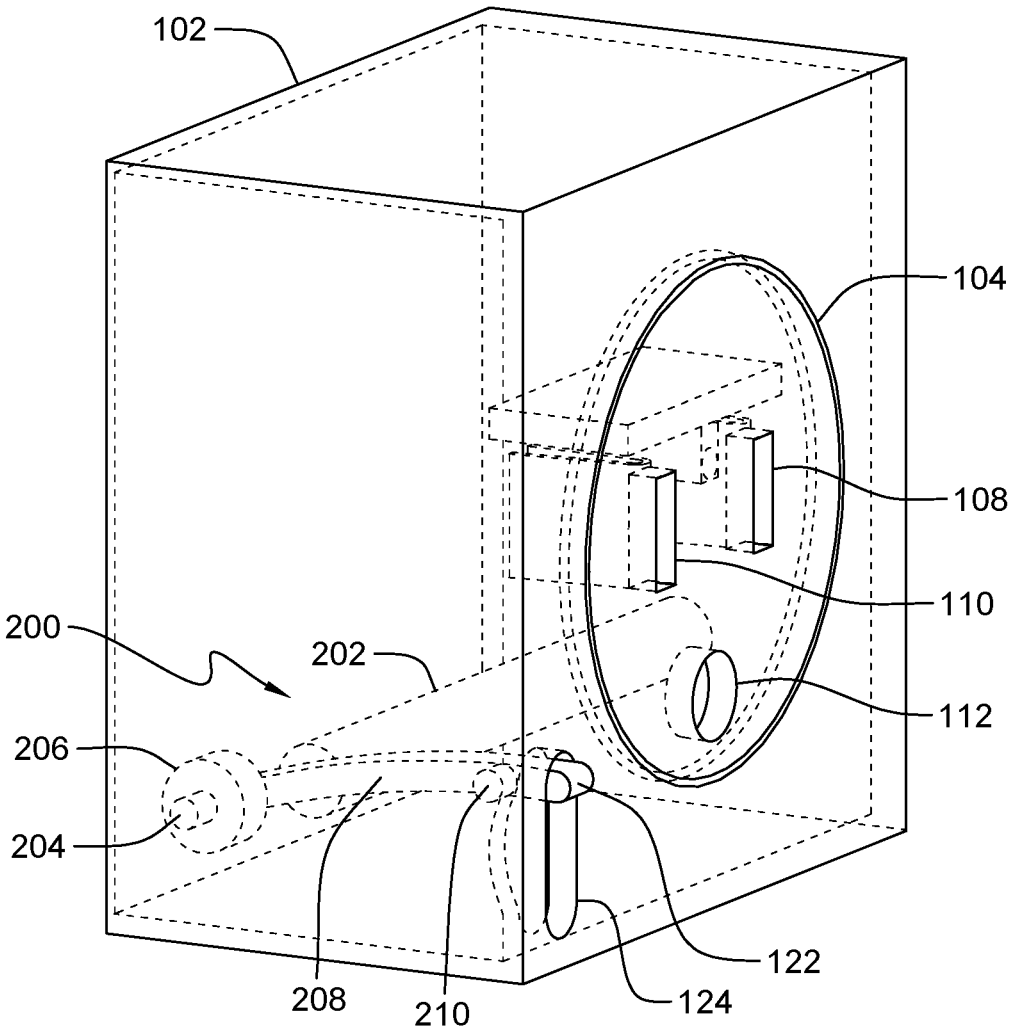
FIG. 2 depicts a transparent 3-dimensional view of a power outlet and receptacle with a retention mechanism, in accordance with an embodiment of the present invention.

FIG. 2 depicts a transparent 3-dimensional view of a power outlet and receptacle with a retention mechanism, in accordance with an embodiment of the present invention. In the illustrated embodiment, retention mechanism 200 is enclosed by receptacle 102, where retention mechanism 200 is positioned below live aperture 108, neutral aperture 110, and ground aperture 112 of power outlet 104. Retention mechanism 200 includes rod 202, pivot pin 204, and release lever 122, where release lever 122 includes pivot pin attachment 206, arm 208, and guide pin 210. Release lever 122 of retention mechanism 200 controls a movement of rod 202, where applying a downward force to release lever 122 unseats rod 202 from indent 120 of ground pin 118 of plug 106 (not illustrated in FIG. 2). Retention mechanism 200 rotates about pivot pin 204 depending on whether rod 202 is seated (i.e., engaged) or unseated (i.e., disengaged) within indent 120 on ground pin 118 of plug 106. Pivot pin 204 of retention mechanism 200 is coupled to interior surface of receptacle 102. In this embodiment, rod 202 is perpendicularly connected to arm 208 of release lever 122 and arm 208 is connected to pivot pin attachment 206 for rotating about pivot pin 204. In another embodiment, rod 202 is connected at an angle to arm 208 of release lever 122, where the rod 202 can be seated and unseated within indent 120 on ground pin 118 of plug 106.

Pivot pin attachment 206 is coupled to one end of a torsion spring and pivot pin 204 is couple to a second end of the torsion spring, where the torsion spring is biased in the clockwise direction. As pivot pin attachment 206 rotates clockwise about pivot pin 204, the torsion spring compresses, arm 208 moves in a downward direction within receptacle 102, and release lever 122 moves in a downward direction along release guide 124. Guide pin 210 is positioned on either side or both sides of arm 208 and glide along an interior wall of receptacle 102 near release guide 124 to provide stability to release lever 122 when a force is applied to release lever 122 in a downward direction to disengaged retention mechanism 200 from indent 120 on ground pin 118 of plug 106. It is to be noted, retention mechanism 200 is grounded to receptacle 102 to ensure a proper electrical ground is provided to ground pin 118 of plug 106. Retention mechanism 200 can be implemented on a variety of conventional power outlet and plug combinations that utilize a grounding pin.

Figure 3A:
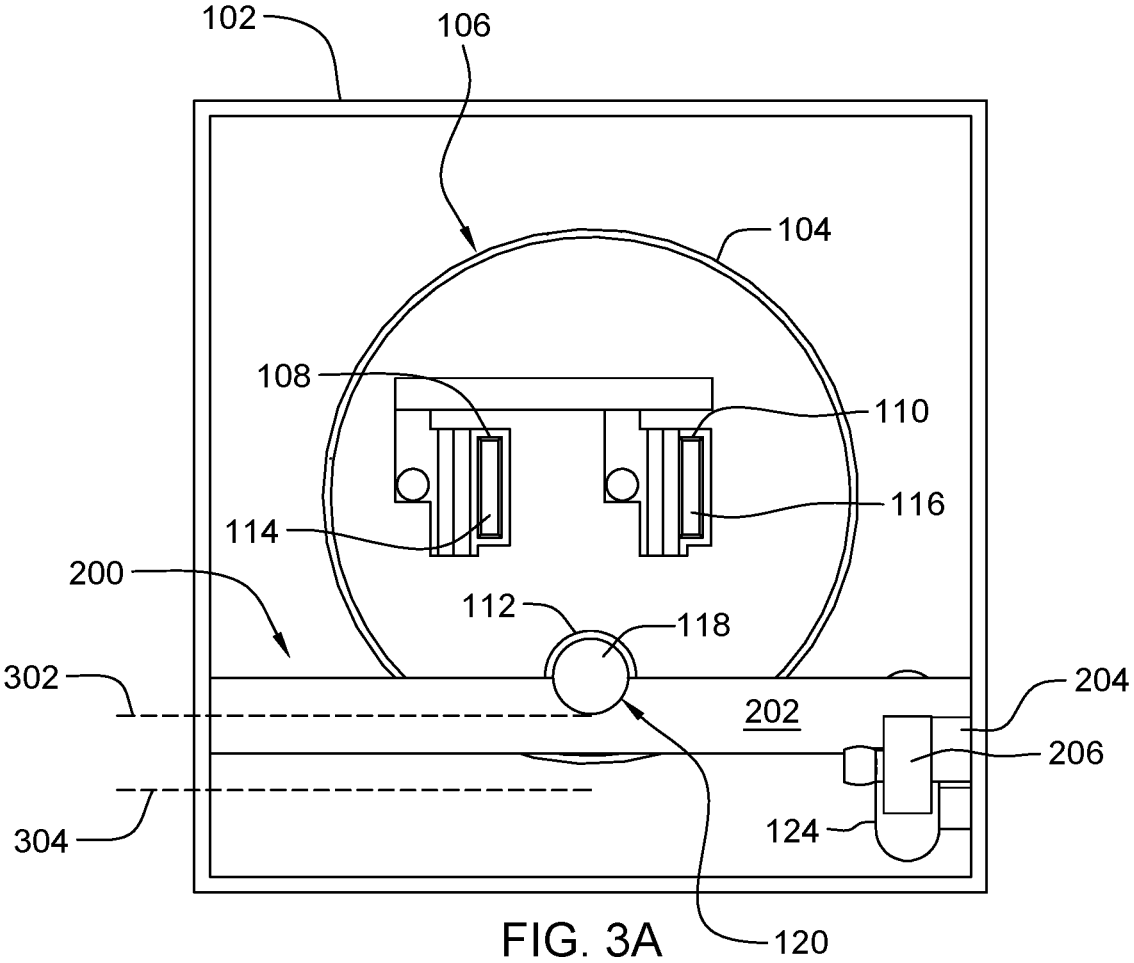
FIG. 3A depicts a rear view of a power outlet and receptacle with a retention mechanism in a locked position, in accordance with an embodiment of the present invention.

FIG. 3A depicts a rear view of a power outlet and receptacle with a retention mechanism in a locked position, in accordance with an embodiment of the present invention. In the illustrated embodiment, plug 106 is inserted in power outlet 104 of receptacle 102, where live pin 114 is disposed in live aperture 108, neutral pin 116 is disposed in neutral aperture 110, and ground pin 118 is disposed in ground aperture 112. Retention mechanism 200 is engaged (i.e., locked position) with ground pin 118 to provide retention and shock protection between power outlet 104 and plug 106. Arm 202 is seated within indent 120 of ground pin 118 when retention mechanism 200 is engaged to prevent plug 106 from being inadvertently removed from power outlet 104. Engaged position line 302 represent a centerline of rod 202 of retention mechanism 200 when rod 202 is seated within indent 120 of ground pin 118. Disengaged position line 304 represents a centerline of rod 202 of retention mechanism 200 when rod 202 is unseated from indent 120 of ground pin 118. Disengaged position line 304 also represents a minimum downward vertical position of rod 202 to allow for the removal of plug 106 from power outlet 104. With rod 202 at engaged position line 302, release lever 122 (not illustrated in FIG. 3A) is at the topmost position in release guide 124. At engaged position line 302, pivot pin attachment 206 can no longer rotate about pivot pin 204, since rod 202 is seated within indent 120 and can no longer move in an upward direction.

Figure 3B:
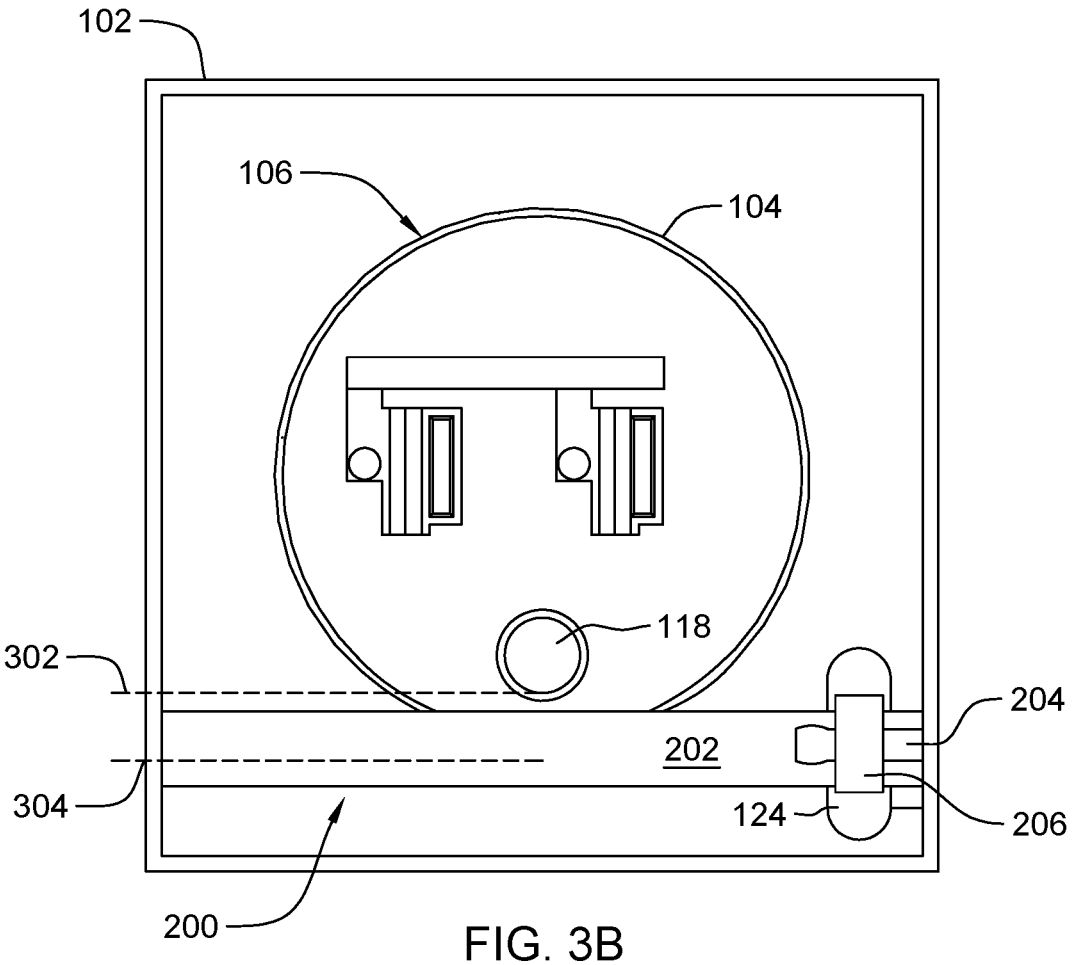
FIG. 3B depicts a rear view of a power outlet and receptacle with a retention mechanism in an unlocked position, in accordance with an embodiment of the present invention.

FIG. 3B depicts a rear view of a power outlet and receptacle with a retention mechanism in an unlocked position, in accordance with an embodiment of the present invention. In the illustrated embodiment, plug 106 is inserted in power outlet 104 of receptacle 102, but retention mechanism 200 is disengaged (i.e., unlocked) from ground pin 118 of plug 106. The disengaged configuration of retention mechanism 200 allows for the removal of plug 106 from power outlet 104. The transition from engaged position line 302 to disengaged position line 304 for the centerline of rod 202, allows for rod 202 to unseat from indent 120 of ground pin 118. At disengaged position line 304, rod 202 clears an interference plane adjacent to an exterior surface of ground pin 118, where indent 120 of ground pin 118 can no longer contact rod 202 if plug 106 is removed from power outlet 104. With rod 202 transitioning from engaged position line 302 to disengaged position line 304, release lever 122 (not illustrated in FIG. 3B) is transitioning downward from the topmost position to a lower position in release guide 124. During the transition, pivot pin attachment 206 rotates about pivot pin 204 in a clockwise direction, as release lever 122 is pressed down from the topmost position to the lower position in release guide 124.

Figure 4A:
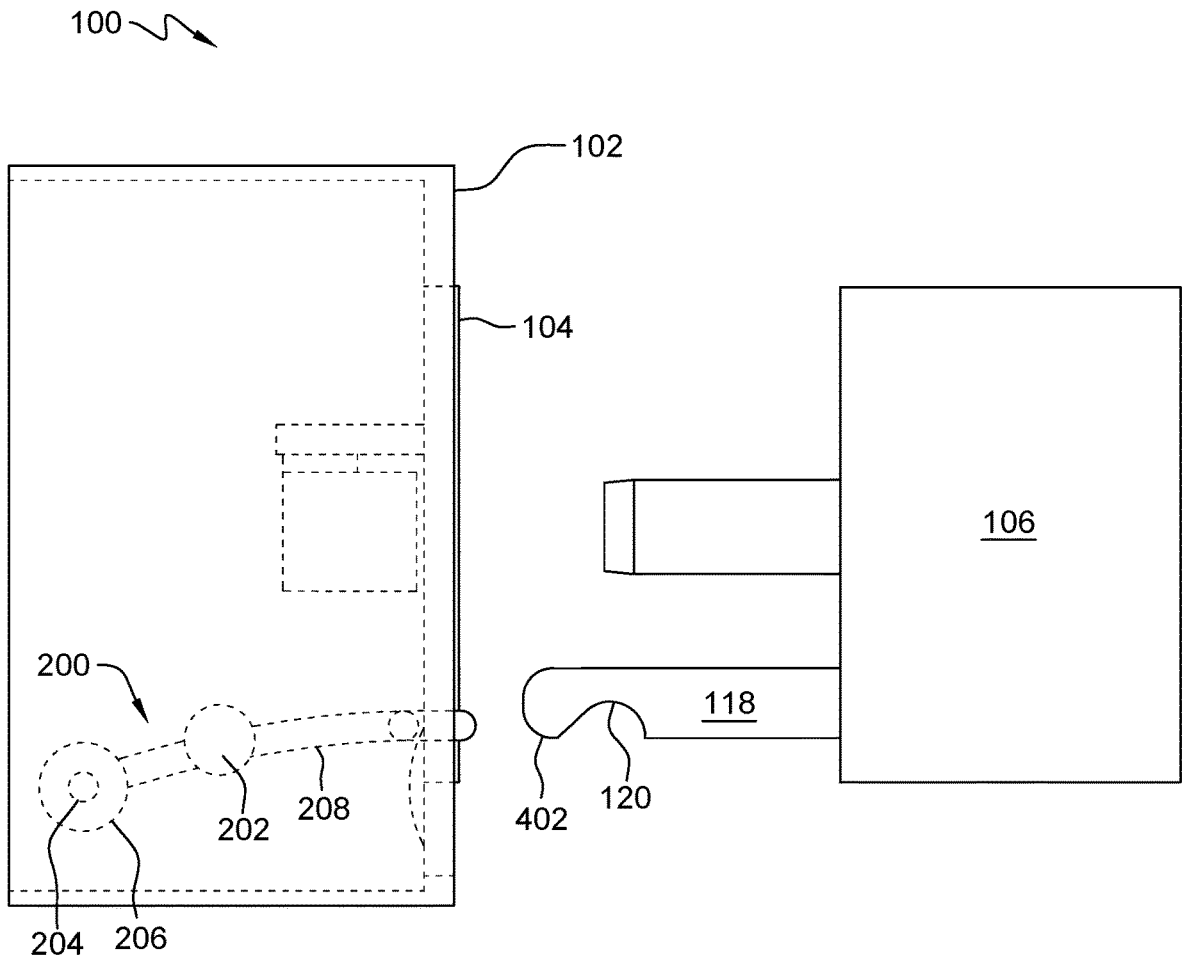
FIG. 4A depicts a transparent side view of a power outlet and receptacle with a retention mechanism and a corresponding plug prior to insertion, in accordance with an embodiment of the present invention.

FIG. 4A depicts a transparent side view of a power outlet and receptacle with a retention mechanism and a corresponding plug prior to insertion, in accordance with an embodiment of the present invention. As previously discussed, power outlet and plug combination 100 includes receptacle 102 with power outlet 104 and plug 106, where plug 106 is insertable into power outlet 104. Plug 106 is positioned such that ground pin 118 is inserted into power outlet 104, where rounded edge 402 of a leading end of ground pin 118 makes initial contact with rod 202 of retention mechanism 200. As plug 106 is inserted into power outlet 104, ground pin 118 enters receptacle and rounded edge 402 is configured to press against a top portion of rod 202. Rounded edge 402 presses on the top portion of rod 202, causing pivot pin attachment 206 to rotate about pivot pin 204 in a clockwise direction. Rod 202 temporarily travels in a downward direction until rod 202 reaches indent 120 of ground pin 118, where then rod 202 travels in an upward direction into indent 120 of ground pin 118. As previously discussed, a torsion spring positioned between pivot pin 204 and pivot pin attachment 206 allows for rod 202 to travel in the upward direction into indent 120 of ground pin 118.

Figure 4B:
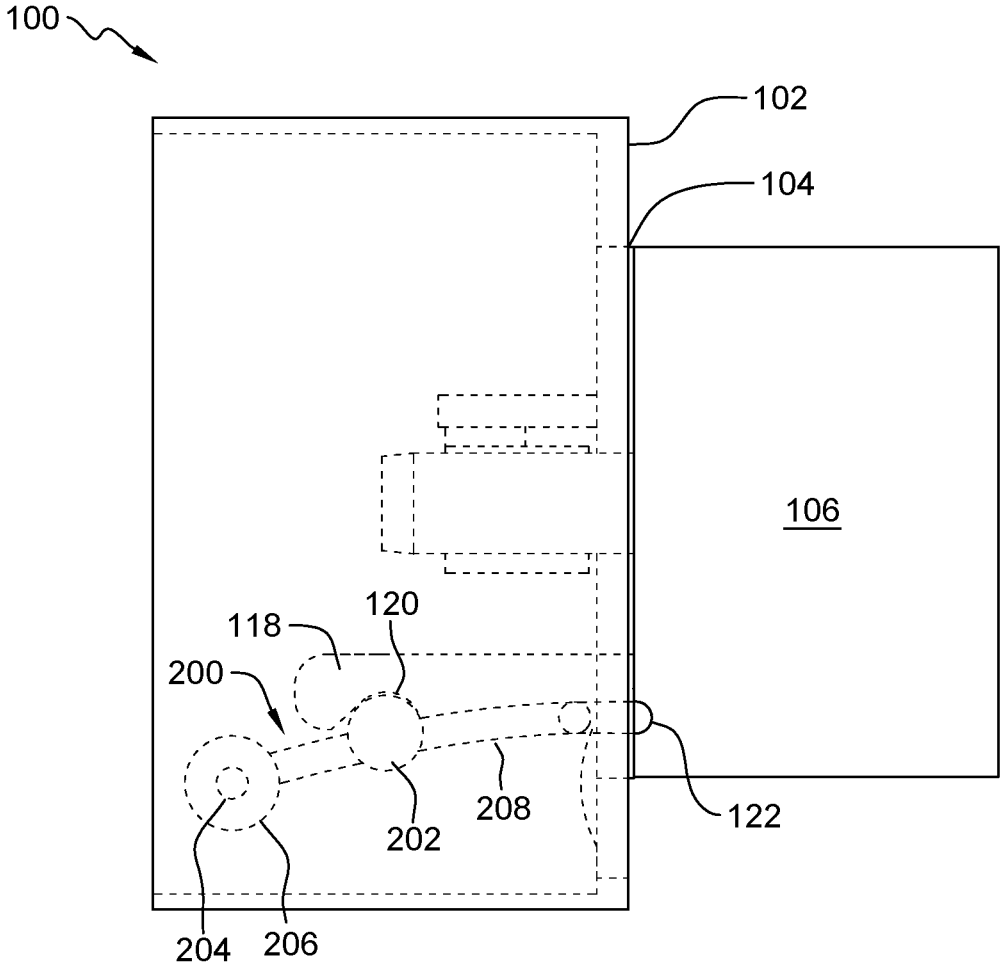
FIG. 4B depicts a transparent side view of a power outlet and receptacle with a retention mechanism and a corresponding plug in a locked position, in accordance with an embodiment of the present invention.

FIG. 4B depicts a transparent side view of a power outlet and receptacle with a retention mechanism and a corresponding plug in a locked position, in accordance with an embodiment of the present invention. In the illustrated embodiment, retention mechanism 200 is engaged (i.e., locked position) with ground pin 118 to provide retention and shock protection between power outlet 104 of receptacle 102 and plug 106, where rod 202 is seated within indent 120 of ground pin 118. The torsion spring positioned between pivot pin 204 and pivot pin attachment 206 results in a rotation force being applied in a counterclockwise direction on pivot pin attachment 206 relative to pivot pin 204. As a result, arm 208 with rod 202 moves in an upward direction, pressing rod 202 into indent 120 of ground pin 118. In the illustrated embodiment, rod 202 is seated within indent 120 of ground pin 118 and can no longer travel in the upward direction. To release plug 106 from power outlet 104, a counter force is applied to the rotational force of the torsion spring via release lever 122. As a downward force is applied to release lever 122, the downward force is translated to arm 208 and pivot pin attachment 206. If the downward force is greater than the rotational force exerted by the torsion spring between pivot pin 204 and pivot pin attachment 206, pivot pin attachment 206 rotations in the clockwise direction. As a result, arm 208 with rod 202 moves in a downward direction and becomes unseated from indent 120 of ground pin 118. Retention mechanism 200 can also include a calculated degree of engagement force to allow for a breakaway disconnection if plug 106 is forcefully pulled while rod 202 is seated within indent 120 of ground pin 118.

Figure 4C:
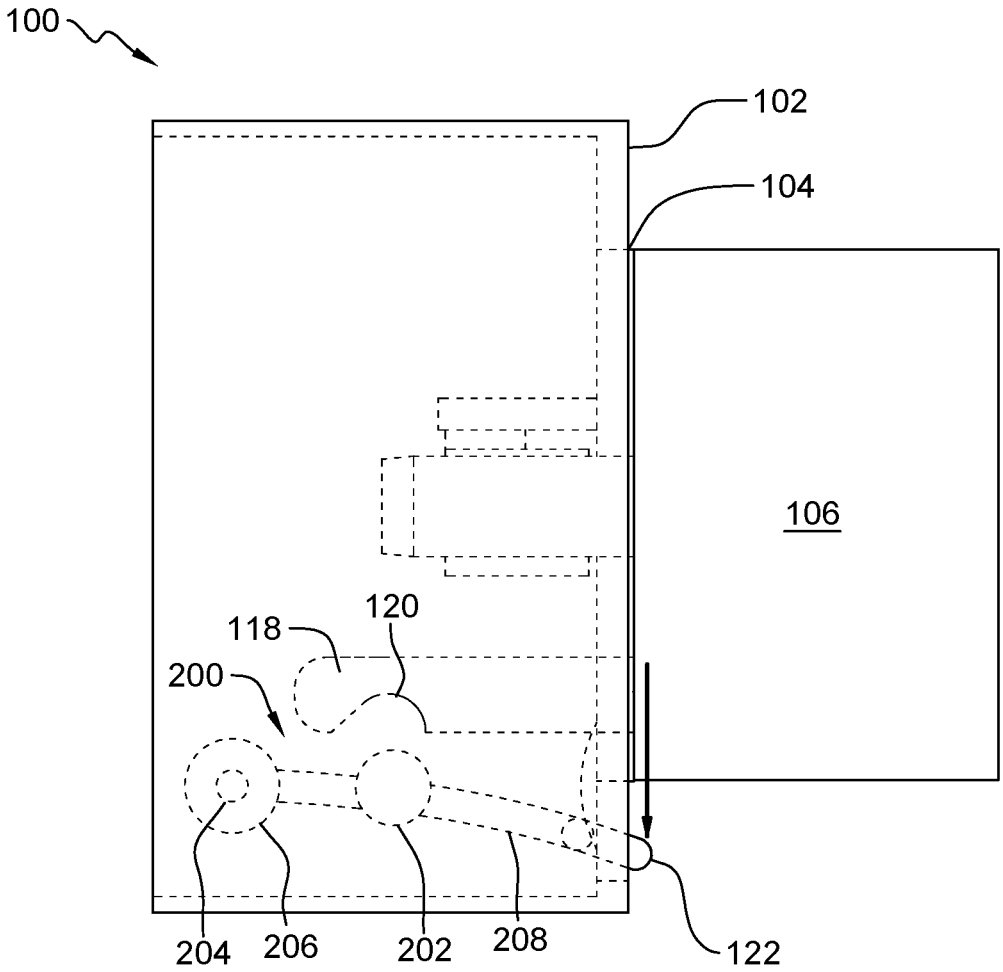
FIG. 4C depicts a transparent side view of a power outlet and receptacle with a retention mechanism and a corresponding plug in an unlocked position, in accordance with an embodiment of the present invention.

FIG. 4C depicts a transparent side view of a power outlet and receptacle with a retention mechanism and a corresponding plug in an unlocked position, in accordance with an embodiment of the present invention. In the illustrated embodiment, retention mechanism 200 is disengaged (i.e., unlocked) from ground pin 118 of plug 106, where the disengaged configuration of retention mechanism 200 allows for the removal of plug 106 from power outlet 104 of receptacle 102. As previously discussed, a counter force is applied to the rotational force of the torsion spring via release lever 122 to unseat rod 202 from indent 120 of ground pin 118. As a downward force is applied to release lever 122, the downward force is translated to arm 208 and pivot pin attachment 206. If the downward force is greater than the rotational force exerted by the torsion spring between pivot pin 204 and pivot pin attachment 206, pivot pin attachment 206 rotations in the clockwise direction. As a result, arm 208 with rod 202 moves in a downward direction and becomes unseated from indent 120 of ground pin 118. Removing the downward force on release lever 122 would result in a decompression of the torsion spring rotating pivot pin attachment 206 counterclockwise about pivot pin 204 and rod 202 would move in an upward direction, pressing rod 202 back into indent 120 of ground pin 118.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a device that "comprises", "has", "includes" or "contains" one or more features possesses those one or more features, but is not limited to possessing only those one or more features. Furthermore, a device or structure that is configured in a certain way is configured in at least that way, but may also be configured in ways that are not listed.

The corresponding structures, materials, acts, and equivalents of all means or step plus function elements in the claims below, if any, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of one or more aspects of the invention and the practical application, and to enable others of ordinary skill in the art to understand one or more aspects of the invention for various embodiments with various modifications as are suited to the particular use contemplated.

What is claimed is:

1. An apparatus comprising:

an electrical plug insertable into a power outlet of a receptacle, wherein the electrical plug includes a ground pin with an indent;

a retention mechanism enclosed by the receptacle includes a rod configured to interact with the indent of the ground pin, wherein the rod seated within the indent of the ground pin prevents a removal of the electrical plug from the power outlet; and a release lever of the retention mechanism for controlling a movement of the rod includes, an arm of the release lever connected to the rod and a pivot pin attachment coupled to a pivot pin of the retention mechanism, wherein the pivot pin attachment rotates about the pivot pit.

2. The apparatus of claim 1, wherein applying a downward force to the release lever unseats the rod from the indent of the ground pin allowing for the removal of the electrical plug from the power outlet.

3. The apparatus of claim 2, wherein the release lever protrudes from the receptacle on a side shared with the power outlet.

4. The apparatus of claim 2, further comprising:

a first end of a torsion spring coupled to the pivot pin attachment and a second end of the torsion spring coupled to the pivot pin.

5. The apparatus of claim 4, wherein a clockwise rotation of the pivot pin attachment relative to the pivot pin compresses the torsion spring.

6. The apparatus of claim 5, wherein the clockwise rotation of the pivot pin attachment translates to a downward movement of the arm and the rod, unseating the rod from the indent of the ground pin.

7. The apparatus of claim 6, wherein a downward movement of the release lever due to the downward force translates to the downward movement of the arm and the rod.

8. The apparatus of claim 4, wherein a counterclockwise rotation of the pivot pin attachment relative to the pivot pin decompresses the torsion spring.

9. The apparatus of claim 8, wherein the counterclockwise rotation of the pivot pin attachment translates to an upward movement of the arm and the rod, seating the rod within the indent of the ground pin.

10. The apparatus of claim 8, wherein the upward movement of the arm and the rod translates to an upward movement of the release lever.

11. The apparatus of claim 4, wherein the rod is perpendicularly connected to the arm of the release lever.

12. The apparatus of claim 4, wherein the pivot pin of the retention mechanism is coupled to an interior wall of the receptacle.

13. The apparatus of claim 4, wherein a rounded edge of a leading end of the ground pin is configured to press against a top portion of the rod.

14. The apparatus of claim 13, wherein pressing against the top portion of the rod results in a compression of the torsion spring and a clockwise rotation of the pivot pin attachment relative to the pivot pin.

15. The apparatus of claim 4, wherein the release lever is positioned within a release guide on the side shared with the power outlet.

16. The apparatus of claim 15, wherein the release guide dictates a vertical movement of the release lever.

17. The apparatus of claim 16, further comprising:

one or more guide pins positioned on the arm configured to guide along an interior wall of the receptacle near the release guide.

18. The apparatus of claim 1, further comprising:

a three-prong electrical plug insertable into the power outlet of the receptacle.

19. An apparatus comprising:

an electrical plug insertable into a power outlet, wherein the electrical plug includes a ground pin with an indent;

a retention mechanism includes a rod configured to interact with the indent of the ground pin, wherein the rod seated within the indent of the ground pin prevents a removal of the electrical plug from the power outlet; and a release lever of the retention mechanism for controlling a movement of the rod includes, an arm of the release lever connected to the rod and a pivot pin attachment coupled to a pivot pin of the retention mechanism, wherein the pivot pin attachment rotates about the pivot pit.

* * * * *